US008761618B2

(12) United States Patent
Aizono

(10) Patent No.: US 8,761,618 B2
(45) Date of Patent: Jun. 24, 2014

(54) IMAGE FORMING APPARATUS, METHOD THEREOF, AND STORAGE MEDIUM

(75) Inventor: Keisuke Aizono, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 116 days.

(21) Appl. No.: 13/595,369

(22) Filed: Aug. 27, 2012

(65) Prior Publication Data

US 2013/0051819 A1 Feb. 28, 2013

(30) Foreign Application Priority Data

Aug. 31, 2011 (JP) ..... 2011-189023

(51) Int. Cl.
*G03G 15/00* (2006.01)

(52) U.S. Cl.
USPC ..... 399/24; 399/10

(58) Field of Classification Search
USPC ..... 399/24, 10
See application file for complete search history.

(56) References Cited

U.S. PATENT DOCUMENTS

2009/0041478 A1* 2/2009 Kamisuwa et al. ..... 399/8
2009/0089076 A1* 4/2009 Asakimori et al. ..... 705/1

FOREIGN PATENT DOCUMENTS

JP 2005-234316 A 9/2005

* cited by examiner

*Primary Examiner* — Walter L Lindsay, Jr.
*Assistant Examiner* — Roy Y Yi
(74) *Attorney, Agent, or Firm* — Canon U.S.A., Inc., IP Division

(57) ABSTRACT

An image forming apparatus capable of counting use of components in the apparatus and managing the counted number of uses as counter information additionally registers in a management table, when it receives an input for newly adding a component whose counter information is to be managed, based on the input, counter information about a different component and setting information indicating that the counter information may be provided external to the image forming apparatus, in association with identification information about the new component, when the identification information about a related different component in the apparatus included in the input is already managed and a count-up condition for the managed different component matches a count-up condition included in the input.

11 Claims, 10 Drawing Sheets

FIG.3

| ID | COMPONENT NAME | UPPER LIMIT | PARENT ID | COUNT-UP CONDITION |
|---|---|---|---|---|
| 10001 | DRUM UNIT (K) | 1000000 | – | WHEN PRINTING L:2/S:1 |
| 10002 | DRUM UNIT (Y) | 700000 | – | WHEN COLOR PRINTING L:2/S:1 |
| 10003 | DRUM UNIT (M) | 700000 | – | WHEN COLOR PRINTING L:2/S:1 |
| 10004 | DRUM UNIT (C) | 700000 | – | WHEN COLOR PRINTING L:2/S:1 |
| 10005 | ITB UNIT | 800000 | – | WHEN PRINTING L:2/S:1 |
| 10006 | ITB BELT | 900000 | 10005 | WHEN PRINTING L:2/S:1 |
| 10007 | CLEANING BLADE | 1000000 | – | WHEN PRINTING L:1/S:1 |

FIG.4A

| ID | COUNTER VALUE | UPPER LIMIT | REPLACEMENT DATE | NUMBER OF REPLACEMENTS | INITIAL VALUE SETTING |
|---|---|---|---|---|---|
| 10001 | 900000 | 1000000 | 20110601 | 1 | DONE |
| 10002 | 400000 | 700000 | 20110501 | 1 | DONE |
| 10003 | 400000 | 700000 | 20110501 | 1 | DONE |
| 10004 | 400000 | 700000 | 20110501 | 1 | DONE |
| 10005 | 300000 | 800000 | 20111231 | 2 | DONE |
| – | – | – | – | – | – |
| – | – | – | – | – | – |

FIG.4B

| ID | COUNTER VALUE | UPPER LIMIT | REPLACEMENT DATE | NUMBER OF REPLACEMENTS | INITIAL VALUE SETTING |
|---|---|---|---|---|---|
| 10001 | 900000 | 1000000 | 20110601 | 1 | DONE |
| 10002 | 400000 | 700000 | 20110501 | 1 | DONE |
| 10003 | 400000 | 700000 | 20110501 | 1 | DONE |
| 10004 | 400000 | 700000 | 20110501 | 1 | DONE |
| 10005 | 300000 | 800000 | 20111231 | 2 | DONE |
| 10006 | 300000 | 900000 | 20111231 | 2 | DONE |
| 10007 | 0 | 1000000 | – | 0 | NOT DONE |

FIG.5

501 502 503 504 505 506 507

| COMPONENT NAME | COUNTER VALUE | UPPER LIMIT | CONSUMPTION LEVEL | REPLACEMENT DATE | NUMBER OF REPLACEMENTS |
|---|---|---|---|---|---|
| DRUM UNIT (K) | 900000 | 1000000 | 90% | 2011/06/01 | 1 |
| DRUM UNIT (Y) | 400000 | 700000 | 57% | 2011/05/01 | 1 |
| DRUM UNIT (M) | 400000 | 700000 | 57% | 2011/05/01 | 1 |
| DRUM UNIT (C) | 400000 | 700000 | 57% | 2011/05/01 | 1 |
| ITB UNIT | 300000 | 800000 | 37% | 2011/12/31 | 2 |
| ITB BELT | 300000 | 900000 | 33% | 2011/12/31 | 2 |
| CLEANING BLADE | NEW | 1000000 | --% | ----/--/-- | 0 |

← → REPLACE OK 508 509 510 511

IMAGE FORMING APPARATUS, METHOD THEREOF, AND STORAGE MEDIUM

BACKGROUND OF THE INVENTION

1. Field of the Invention

The present invention relates to a technology for managing counter information when replacing a component in an image forming apparatus.

2. Description of the Related Art

A multifunction peripheral, which is an example of an image forming apparatus, is configured from many components, some of which need to be periodically replaced. Consumed components are replaced as necessary by confirming the state of each component.

The person who replaces and cleans these components, and who manages the multifunction peripheral so that it runs normally, is a service person responsible for maintaining the multifunction peripheral. The service person periodically visits a customer to confirm the consumption level of the components.

However, there is a limit to how well the service person can visually confirm the consumption level of the components. Therefore, it has been proposed that the service person be notified of a replacement time for a component by measuring the consumption level of the components that need to be periodically replaced with the multifunction peripheral.

Specifically, counter information (hereinafter, "component counter") is provided for each component, and each time a consumption operation is performed, the component counter associated with that is counted up. For example, for a component that is consumed each time a printing operation is performed, such as a drum in the multifunction peripheral, the counting up is based on the size of paper when the paper is fed. Generally, the service person can be notified of a component's replacement time by comparing the component counter with a predetermined upper limit for that component.

Further, the components that are managed using such a component counter are often predetermined. Japanese Patent Application Laid-Open No. 2005-234316 discusses a technology in which a unit replacement warning message is displayed when the remaining life of at least one of the components mounted in a component unit in which a plurality of components are grouped together falls to a predetermined reference value or less.

As stated above, when replacing a component in a multifunction peripheral, the replacement operation may be performed by replacing a component unit in which a plurality of components are grouped together, as this facilitates the replacement operation. However, if the component unit has a high cost, the service person can decide to replace only the components in the unit that may need to be frequently replaced. Although such a case does not entail any new components being added to the multifunction peripheral, it does mean that during operation the number of components, each consumption level of which needs to be grasped, increases, and that a component counter that has to be managed needs to be newly added to the multifunction peripheral.

For multifunction peripherals that are already being used by customers, the new component counter is not counted-up for the consumption operations utilized until that point. Consequently, when the component counter is newly added, the component counter has a counter value when it is added that starts from zero.

However, the component corresponding to the added component counter has been thoroughly used in operations up to that point. Therefore, a discrepancy arises between the actual consumption level of the component and the value of the component counter. In this case, since the value of the component counter is less than the actual consumption level of the component, the component may break down or quality may deteriorate even though the component counter has not reached its upper limit.

SUMMARY OF THE INVENTION

An aspect of the present invention is directed to a technology for managing counter information when replacing a component in an image forming apparatus.

According to an aspect of the present invention, an image forming apparatus capable of counting use of components in the apparatus and managing the counted number of uses as counter information, includes a storage unit configured to store in a storage device counter information, identification information about a related different component in the apparatus, a count-up condition, and setting information indicating whether the counter information may be provided external to the image forming apparatus, in association with identification information about each of a plurality of components whose counter information is to be managed, an input unit configured to receive an input for newly adding a component whose counter information is to be managed, a registration unit configured to register in the storage device identification information about a new component to be included in the input, the identification information about the related different component in the apparatus, and the count-up condition based on the input, and a provision unit configured to provide, external to the image forming apparatus, counter information whose setting information stored in the storage device indicates that the counter information may be provided externally, wherein the registration unit is configured to, based on the input, register the counter information about the different component and the setting information indicating that the counter information may be provided externally, in association with identification information about a new component when the identification information about the related different component in the apparatus included in the input is stored in the storage device, and the count-up condition for the stored different component matches a count-up condition included in the input.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 3 illustrates an example of a component counter master list.

FIGS. 4A and 4B illustrate examples of a component counter registration list.

FIG. 5 illustrates a screen example of a component counter display unit.

DESCRIPTION OF THE EMBODIMENTS

Various exemplary embodiments, features, and aspects of the invention will be described in detail below with reference to the drawings.

Figure 1:
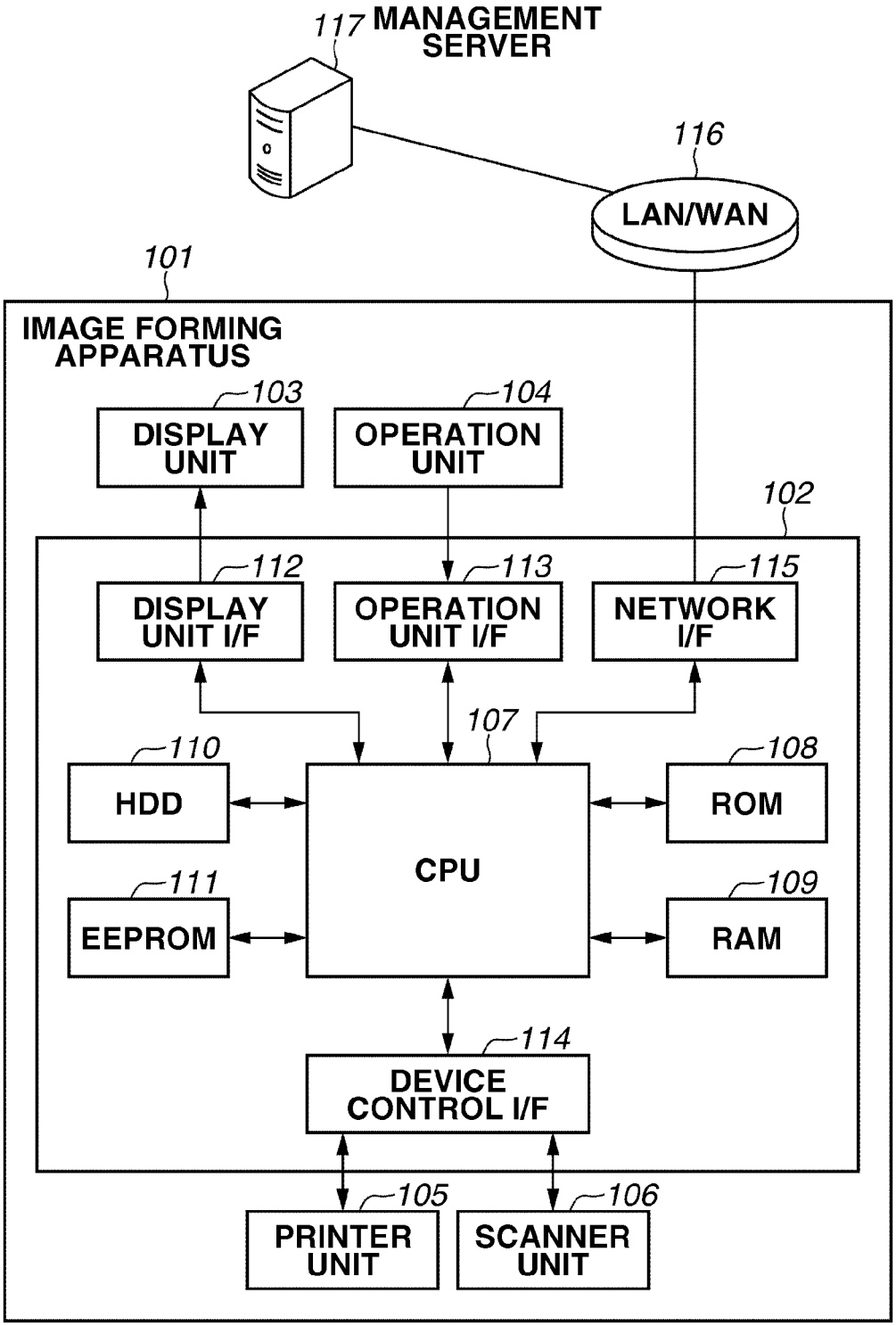
FIG. 1 is a block diagram of a system in an image forming apparatus according to an exemplary embodiment of the present invention.

FIG. 1 is a block diagram illustrating a system configuration of an image forming apparatus according to an exemplary embodiment.

An image forming apparatus 101 includes a controller unit 102, a display unit 103, an operation unit 104, a printer unit 105, and a scanner unit 106.

The display unit 103, which includes light-emitting diodes (LEDs) and a liquid crystal display, displays the contents of an operation from an operator and the internal state of the image forming apparatus 101. The operation unit 104 receives operations from the operator. The operation unit 104 may include a plurality of operation buttons, or may be realized as a touch display with the display unit 103.

The printer unit 105 prints image data transmitted from the controller unit 102 on printing paper based on a print instruction from the controller unit 102. The printer unit 105 is connected to the controller unit 102 via a device control I/F 114.

The scanner unit 106 performs a scanning operation by receiving a scan instruction from the controller unit 102, and transmits the image data to the controller unit 102. The scanner unit 106 is connected to the controller unit 102 via the device control I/F 114.

The controller unit 102 includes a central processing unit (CPU) 107, a read-only memory (ROM) 108, a random access memory (RAM) 109, a hard disk drive (HDD) 110, an electrically erasable programmable ROM (EEPROM) 111, a display unit I/F 112, an operation unit I/F 113, and the device control I/F 114.

The CPU 107 executes control programs included in the image forming apparatus 101. The CPU 107 controls the operations of devices that are connected to the controller unit 102 via the respective I/Fs and a memory in a storage medium.

The ROM 108 is a read-only memory in which a boot program necessary for system startup is stored. The RAM 109 is a volatile memory that acts as a work memory required when executing the control programs.

The HDD 110 is a storage medium, such as a magnetic disk, which stores the control programs and image data. The EEPROM 111 is a non-volatile memory that stores setting values that are required when executing the control programs. The EEPROM 111 also stores counter values of component counters and the like.

The device control I/F 114 controls input/output to/from the devices (the printer unit 105 and the scanner unit 106) connected to the controller unit 102. The device control I/F 114 can be realized as a bus structure capable of connecting to a plurality of devices, but can also be divided into a plurality of I/Fs so that one I/F is included for each connected device. The display I/F 112 outputs control information to the display unit 103. The operation unit I/F 113 receives input information from the operation unit 104.

The image forming apparatus 101 is connected to a local area network (LAN)/wide area network (WAN) 116 via a network I/F 115. The image forming apparatus 101 provides a management server 117 with information (component counter information etc.) stored by the image forming apparatus 101, as well as event information such as jams and paper-out conditions.

The management server 117 is an apparatus for remote monitoring of a plurality of image forming apparatuses via a network. The management server 117 also manages information about customers using the image forming apparatuses. Further, the management server 117 collects and stores failure information and counter information about the image forming apparatuses, and analyzes each state of the image forming apparatuses. In addition, the management server 117 provides a service for the handling of broken or consumed components, and the dispatch of a service person responsible for the maintenance of the image forming apparatuses.

Figure 2:
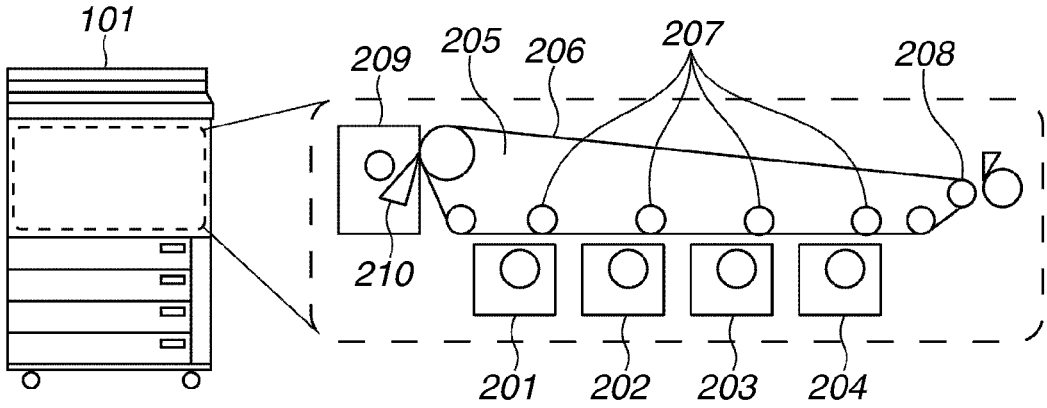
FIG. 2 illustrates an example of the components in a printer unit.

Next, in FIG. 2, the components of the printer unit 105 in the image forming apparatus 101 will be described as an example, along with their functions.

The printer unit 105 includes a drum unit (Y) 201, a drum unit (M) 202, a drum unit (C) 203, a drum unit (K) 204, an ITB unit 205, and an ITB cleaning unit 209.

The drum unit (Y) 201, the drum unit (M) 202, and the drum unit (C) 203 are used to expose an internal drum with laser light to develop a color image. The drum unit (K) 204 is a unit that develops an image that includes black. For a monochrome black image, the drum unit (K) 204 performs a development operation, while the drum unit (Y) 201, the drum unit (M) 202, and the drum unit (C) 203 do not perform a development operation.

After development, toner is transferred onto the ITB unit 205. The ITB unit 205 includes an ITB belt 206, a primary transfer roller 207, and a secondary transfer roller 208.

The ITB unit 205 performs primary transfer of the toner developed by the drum units (201, 202, 203, and 204) onto the ITB belt 206, where the primary transfer roller 207 is located. Next, the ITB unit 205 transfers toner onto the printing paper where the secondary transfer roller 208 is located. After the secondary transfer, the printing paper is subjected to a fixing process, and then discharged from the image forming apparatus 101.

The toner remaining on the ITB belt 206 is cleaned by the ITB cleaning unit 209. Specifically, the toner adhering to the ITB belt 206 is removed with a cleaning blade 210 in the ITB cleaning unit 209.

Hereinafter, in the present exemplary embodiment, a component counter will be described using the components described in FIG. 2.

A method for managing the component counter will now be described using FIGS. 3 and 4.

FIG. 3 illustrates a component counter master list stored in the HDD 110 as a data file or hard-coded in a control program.

The CPU 107 uses the component counter master list by rasterizing the list from the HDD 110 in the RAM 109. The master list includes identification information (ID, component name), an upper limit, a parent ID, and a count-up condition.

The ID is a number for uniquely specifying the component counter. The component name is what the component is called when displayed on the display unit 103, for example. The upper limit is a predetermined target value for determining a component replacement timing. The component counter indicates that the component needs to be replaced when the upper limit is, or has been, exceeded.

The parent ID is an ID for indicating a parent-child relationship of a component. Here, the ITB unit 205 and the ITB belt 206 will be described as an example of a component parent-child relationship.

As stated above, the ITB unit 205 is formed from components including the ITB belt 206. This relationship, in which the ITB unit 205 includes the ITB belt 206, is called a parent-child relationship. As seen from the ITB unit 205, the ITB belt 206 is referred to as a child component, and as seen from the ITB belt 206, the ITB unit 205 is referred to as a parent component. The information indicating this parent-child relationship in the component counter master list is the parent ID, which shows the ID of the parent component. Since the parent ID is only described for the child components in the master list, not all of the components have a parent ID.

In the example of FIG. 3, for the ITB belt 206 with the ID: 10006, the ITB unit 205 with the ID: 10005 is the parent component. Therefore, 10005 is described in the parent ID of ID: 10006, which refers to a child component, thereby indicating a parent-child relationship.

Next, the count-up condition in FIG. 3 will be described using the drum unit (K) 204 with the ID: 10001 and the drum unit (Y) 201 with the ID: 10002 as an example. The count-up condition indicates how much to count-up the component counter based on the type of operation that is performed. For the drum unit (K) 204, since this unit will definitely be operated regardless of the color to be printed, the condition for counting up is "when printing".

On the other hand, for the drum unit (Y) 201, since this unit is not operated during a monochrome black operation, the condition for counting up is "when color printing". Further, since the consumption level of the drum units changes based on the printed paper size, a count-up of 2 is needed for large sizes and a count-up of 1 for small sizes. Consequently, the count-up value of the component counter condition for ID: 10001 and ID: 10002 is "L:2/S:1". However, these conditions should only be considered as drum unit count-up conditions. Obviously the count-up conditions will be different for each component.

FIGS. 4A and 4B respectively illustrate a component counter registration list that is stored in the EEPROM 111.

The CPU 107 uses the component counter registration list by rasterizing the list from the EEPROM 111 in the RAM 109.

The registration list is configured from an ID, a counter value, an upper limit, a replacement date, a number of replacements, and an initial value setting.

Similar to the master list ID, the ID is a number for uniquely specifying the component counter. The counter value is a value indicating a consumption level of a component. Similar to the master list upper limit, the upper limit in the registration list is a predetermined target value for determining a component replacement timing.

In contrast to the master list upper limit, which is a default value during addition of a component counter, the registration list upper limit may be stored as a value that can be changed by the operator with the operation unit 104. Consequently, usually, the upper limit in the registration list is used. The replacement date is the date when the component was last replaced. The number of replacements is the number of times that the component has been replaced up to that point. Each time the component is replaced, the count goes up by 1.

The initial value setting is information for confirming whether the value of the component counter indicates an operationally usable state. Specifically, a value is stored that indicates whether an initial value for the counter value is set ("done") or not set ("not done"). If the value of the component counter indicates an operationally usable state, this means that this value can be handled as reliable information without any problems even if provided outside via various interfaces as information for determination of the replacement timing or for analysis to the management server 117.

Next, using FIG. 5, an example will be described of a component counter screen displayed on the display unit 103 using the above-described component counter information.

A component counter screen 501 is configured from a component name 502, a counter value 503, an upper limit 504, a consumption level 505, a replacement date 506, a number of replacements 507, a "←" button 508, a "→" button 509, a "replace" button 510, and an "OK" button 511.

The CPU 107 displays the component counter information on the display unit 103 via the display unit I/F 112 by rasterizing the component counter master list and the component counter registration list in the RAM 109 and by acquiring the information needed for the component counter screen 501.

The component name 502 is displayed by acquiring it from the master list. The counter value 503, the upper limit 504, the replacement date 506, and the number of replacements 507 are displayed by acquiring them from the registration list. The consumption level 505 is displayed by calculating a ratio based on the counter value 503 and the upper limit 504.

The "←" button 508, the "→" button 509, the "replace" button 510, and the "OK" button 511 are buttons for receiving instructions from the operator. The CPU 107 acquires operation information via the operation unit I/F 113. The "←" button 508 and the "→" button 509 are used when the component counter information extends over a plurality of pages. The "←" button 508 is used to switch to the previous page, and the "→" button 509 is used to switch to the next page.

The "replace" button 510 is used by the CPU 107 to detect that a component has been replaced. Although in the present exemplary embodiment the replacement of a component is detected based on notification from the operator, component replacement may also be automatically detected without displaying the "replace" button 510. The "OK" button 511 is a button for closing the component counter screen 501.

In FIG. 5, the component name "cleaning blade" has a counter value of "NEW". This indicates that the component was added as a count target based on the processing described below, and that there is no reliable counter information for this value. The service person can manually input the current counter information by pressing the "NEW" portion on the operation unit 104. Setting processing of the counter information based on this input will be described below using FIG. 9.

Next, count-up processing of the component counter displayed in the counter value 503 will be described using FIG. 6.

The count-up processing is executed by the CPU 107 operating the printer unit 105 or the scanner unit 106 via the device control I/F when the CPU 107 receives a print instruction or a scanning instruction from the operation unit 104.

Figure 6:
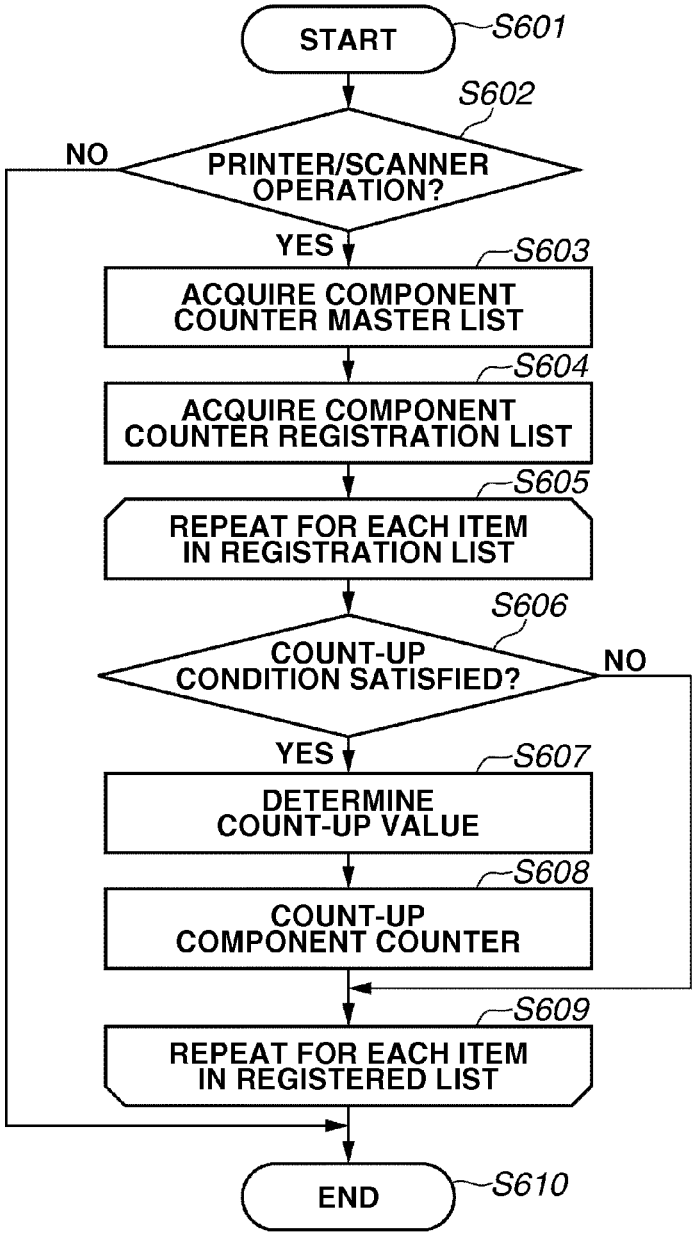
FIG. 6 is a flowchart illustrating count-up processing.

FIG. 6 is a flowchart illustrating an example of component counter count-up processing.

In step S601, the processing starts. Then, in step S602, the CPU 107 determines whether there has been a device operation by the printer unit 105 or the scanner unit 106. Generally, a component is consumed by print processing or scanning processing being performed.

Consequently, if it is determined in step S602 that there has been a device operation by the printer unit 105 or the scanner unit 106 (YES in step S602), the processing proceeds to the count-up processing performed from step S603 onwards. If it is determined that there has not been a device operation (NO in step S602), since a component has not been consumed, the processing proceeds to step S610, and the count-up processing ends. If there is a component that is consumed regardless of whether there has been a device operation, such condition can be added to step S602.

In step S603, the CPU 107 gets ready for the count-up processing by rasterizing in the RAM 109 the component counter master list from in the control program or from the HDD 110 that has the data file. In step S604, the CPU 107 gets ready for the count-up processing by rasterizing the component counter registration list from the EEPROM 111 in the RAM 109.

From step S605 to step S609, the count-up processing is performed on all of the component counters in the registration list. In step S606, the CPU 107 determines whether the device operation matches the count-up condition of the target component in the master list in the RAM 109 about the component counter of the target component. If there is no match (NO in step S606), since it is not necessary to perform counting up, the processing proceeds to the next component (step S609). If there is a match, the processing proceeds to the count-up processing in steps S607 to S610. The count-up condition is as described above based on FIG. 3.

In step S607, the CPU 107 determines the count-up value. For example, if the master list count-up condition is "L:2/S:1", the large size printing paper is determined to be 2 and small size printing paper is determined to be 1. In step S608, the count-up value determined in step S607 is added to the counter value in the registration list, and stored in the EEPROM 111.

In step S609, after performing count-up, if there is a next component to be processed, the processing returns to step S605. Further, in step S610, if the checking of all the component counters in the registration list has finished, the CPU 107 finishes the count-up processing.

Next, using FIG. 7, an example of component counter replacement processing will be described. This processing is one of the basic operations of the component counter as well as the count-up processing.

The component counter replacement processing is executed when the CPU 107 receives a replacement notification from the operation unit 104, or an automatic detection notification for component replacement from the printer unit 105 or the scanner unit 106.

Figure 7:
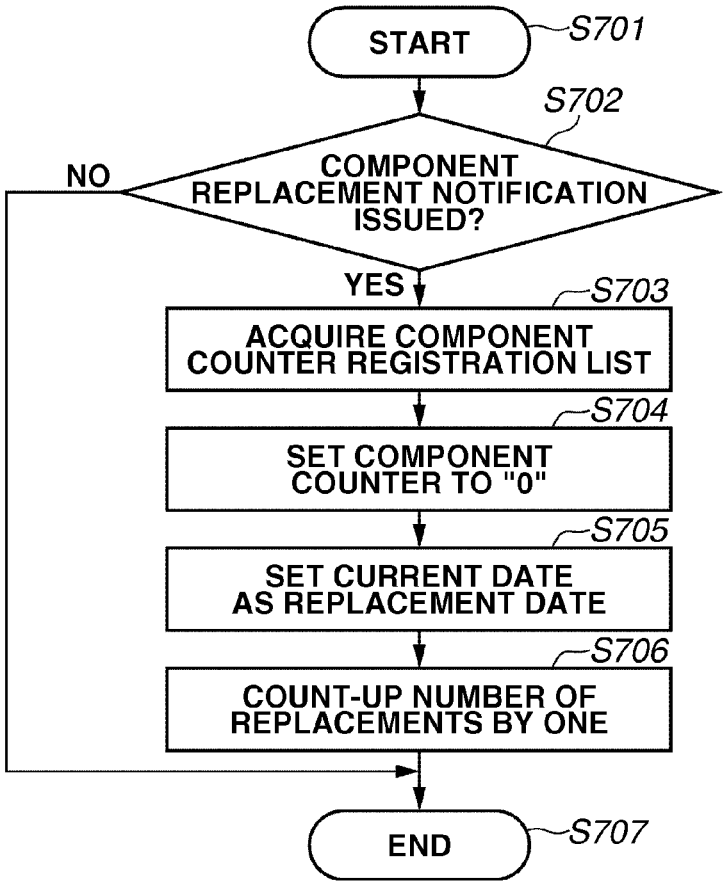
FIG. 7 is a flowchart illustrating replacement processing.

FIG. 7 is a flowchart illustrating an example of the component counter replacement processing.

In step S701, the CPU 107 starts the component counter replacement processing. Then, in step S702, the CPU 107 determines whether a component replacement notification has been issued. This is not limited to the notification, from the operation unit 104, of pressing the "replace" button 510, and the notification may be based on the result of automatic detection of component replacement for various reasons, including a break down. If it is determined that there has not been a replacement notification (NO in step S702), the processing proceeds to step S707, and the processing ends. If it is determined that there has been a replacement notification (YES in step S702), the processing proceeds to step S703.

In step S703, the CPU 107 gets ready for the replacement processing by rasterizing the component counter registration list from the EEPROM 111 in the RAM 109. In step S704, the CPU 107 sets the counter value for the relevant component counter in the registration list to zero. In step S705, the CPU 107 sets the current date as a replacement date. In step S706, the CPU 107 adds 1 to the number of replacements. At this stage, if the initial value setting of the replacement component is "not done", the CPU 107 updates this to "done". Further, these updated values are saved from the RAM 109 in the EEPROM 111, and then in step S707 the processing ends.

Next, using FIG. 8, an operation that is performed when a component counter is to be added to an image forming apparatus that is already being used by a customer will be described.

Component counter addition processing is executed by the CPU 107 when the version of the master list stored in the HDD 110 is different from the version of the registration list stored in the EEPROM 111. Specifically, the service person updates the master list by updating firmware, for example, and then based on the updated master list, updates the registration list.

Figure 8:
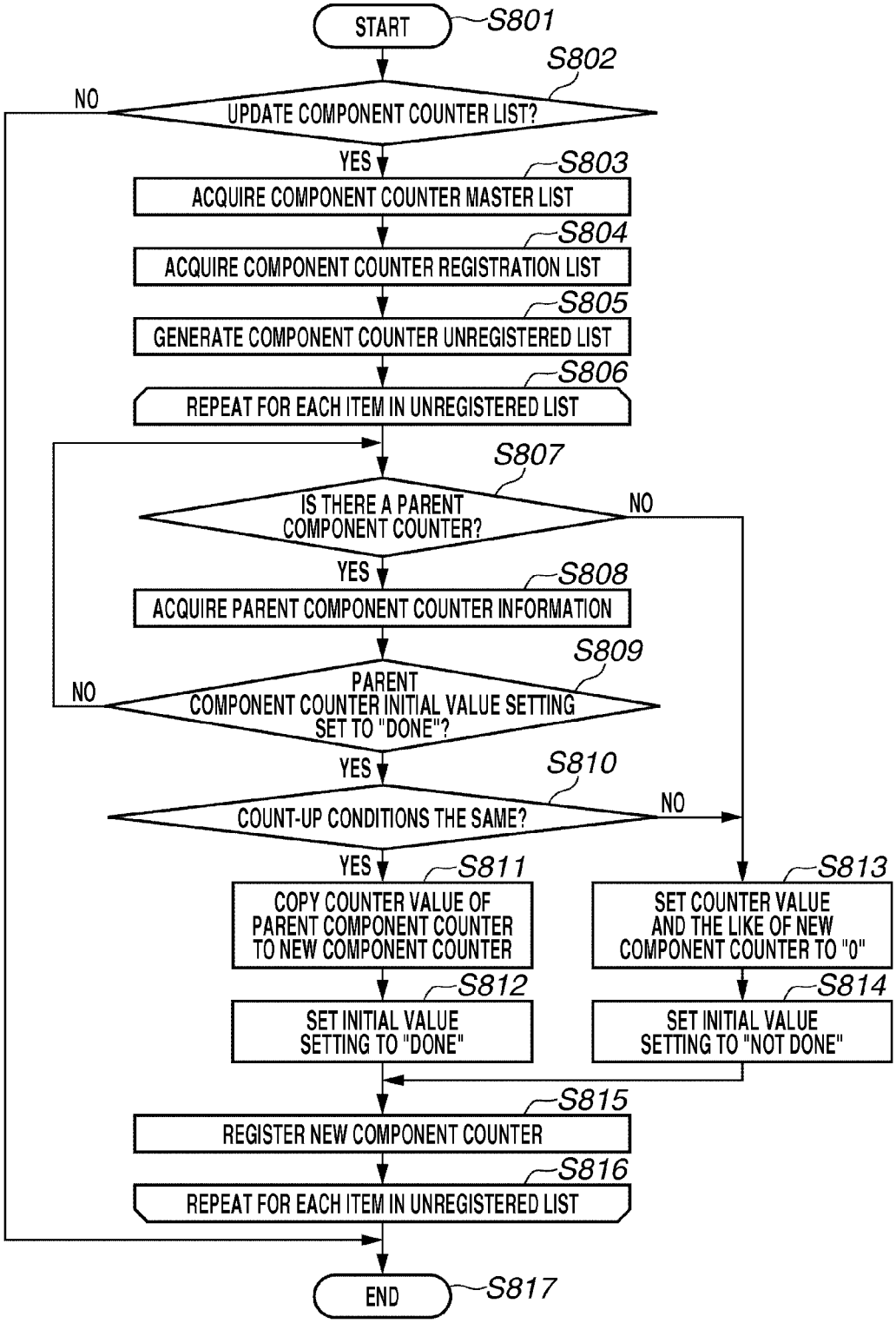
FIG. 8 is a flowchart illustrating addition processing of a component counter.

FIG. 8 is a flowchart illustrating component counter addition processing.

In step S801, the processing starts. Then, in step S802, the CPU 107 determines whether there has been an input indicating update of the component counter master list. This determination is performed by comparing the versions of the master list and the registration list. The update check is not limited to comparing versions, and can also be performed by some other methods. If it is determined that there has been no update input (NO in step S802), since it is not necessary to add a component counter to the registration list, the processing proceeds to step S817, and the processing ends. If it is determined that there has been an update input (YES in step S802), the processing proceeds to the addition processing performed in step S803 onwards.

In step S803, the CPU 107 gets ready for the addition processing by rasterizing in the RAM 109 the component counter master list from in the control program or from the HDD 110 that has the data file. In step S804, the CPU 107 gets ready for the addition processing by rasterizing the component counter registration list from the EEPROM 111 in the RAM 109.

In step S805, the CPU 107 generates an unregistered list in the RAM 109 based on the difference between the master list and the registration list. Specifically, in the example of the master list in FIG. 3 and the registration list in FIG. 4A, the unregistered list will consist of ID: 10006 and ID: 10007.

Then, the registration processing performed in steps S806 to S816 is repeated for each item in the unregistered list.

In step S807, the CPU 107 checks whether there is a parent component counter for the component counter to be additionally registered. For ID: 10006, since there is 10005 as the parent ID in the master list, the CPU 107 determines that there is a parent component counter (YES in step S807). On the other hand, for ID: 10007, since there is no parent ID in the master list, the CPU 107 determines that there is no parent component counter (NO in step S807). Since there is no information to be inherited if there is no parent component, the processing proceeds to step S813. If there is a parent component, since there may be more counter information to be inherited, the processing proceeds to step S808.

In step S808, the CPU 107 acquires information about the parent component counter from the master list and the registration list. For a component counter having the ID: 10006, the CPU 107 acquires information about the ID: 10005, which is the parent component.

In step S809, the CPU 107 checks whether the initial value setting of the parent component counter acquired in step S808 is set to "done". If the initial value setting is set to "not done" (NO in step S809), since the counter value of the parent component is not in a usable state, the processing returns to step S807, and the CPU 107 again checks whether there is a parent component counter. If the initial value setting is set to "done" (YES in step S809), since there may be more information to be inherited about the parent component, the processing proceeds to a check performed in step S810.

In step S810, the CPU 107 checks whether a count-up condition for the component counter to be added and the count-up condition for its parent component counter are the same. The comparison of count-up conditions uses the count-up condition in the master list. If it is determined that the count-up conditions are different (NO in step S810), since the counter value of the parent component counter cannot be inherited, the processing proceeds to step S813. If it is determined that the count-up conditions are the same (YES in step S810), since the counter value of the parent component counter can be inherited, the processing proceeds to parent component counter inheritance processing performed from step S811 onward.

In step S811, the CPU 107 copies the values for the counter value, the replacement date, and the number of replacements regarding the parent component counter into the component counter to be added, so that the information about the parent component counter can be inherited. In step S812, since the initial value for the counter value of the component counter added in step S811 has been set, the CPU 107 sets the initial value setting to "done".

On the other hand, if it is determined in step S807 or step S810 that the parent component counter cannot be inherited (NO in steps S807 and S810), the processing proceeds to step S813. In step S813, the CPU 107 sets the counter value, the replacement date, and the number of replacements of the component counter to be added to zero. In step S814, since the component counter to be added is not in a usable state, the CPU 107 sets the initial value setting to "not done". For a component counter having an initial value setting set to "not done", the component counter becomes usable when the initial value of the counter value is set.

In step S815, the CPU 107 adds the component counter to be added to the registration list, and stores the updated registration list from the RAM 109 in the EEPROM 111.

When the processing of all the component counters in the unregistered list has finished, in step S817, the CPU 107 ends the addition processing.

As illustrated in the example in FIG. 4B, addition processing for the component counters with the ID: 10006 and the ID: 10007 is performed based on the above addition processing. Specifically, when adding a child component counter to some of the components that are already in the registration list, the initial counter value and the like are automatically set. However, when adding a component counter that does not have a parent component in the registration list, since the initial value setting is set to "not done", the initial counter value setting needs to be set.

Processing of the initial counter value setting will now be described using FIG. 9.

The initial counter value setting processing is executed by the CPU 107 when there is an input of an initial counter value setting from the operation unit 104. This processing is performed after the service person has updated the image forming apparatus firmware, confirmed whether counter management for a new component has been performed based on the list illustrated in FIG. 5, and entered an input indicating that there is a target component.

Figure 9:
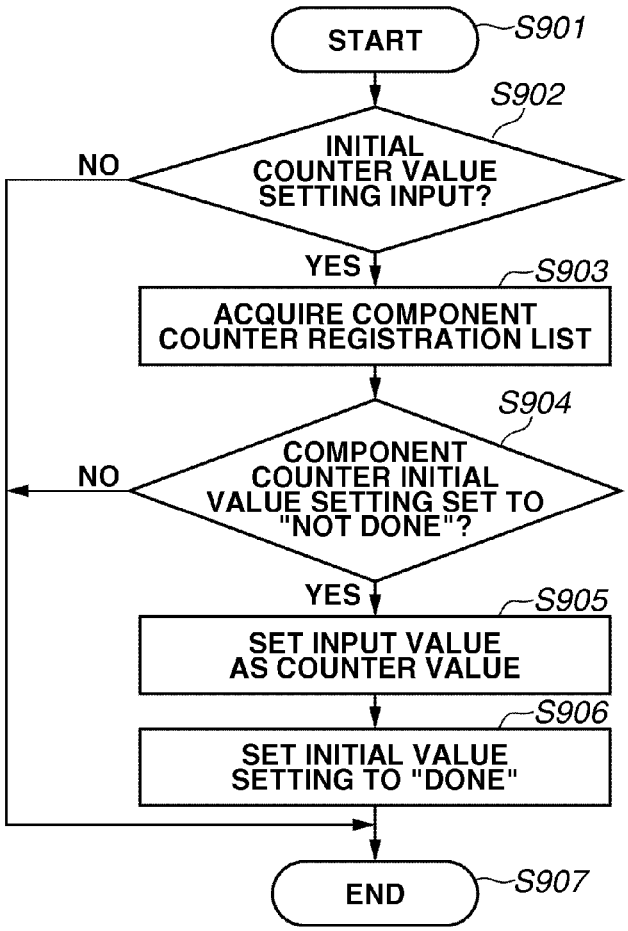
FIG. 9 is a flowchart illustrating setting processing of an initial counter value.

FIG. 9 is a flowchart illustrating the setting processing of an initial counter value of a component counter.

In step S901, the CPU 107 starts the processing. Then, in step S902, the CPU 107 checks whether there has been an input of an initial counter value setting from the operation unit 104. If it is determined that there has not been an input (NO in step S902), the processing proceeds to step S907, and the processing ends. If it is determined that there has been an input (YES in step S902), the processing proceeds to step S903.

In step S903, the CPU 107 gets ready for the initial counter value setting processing by rasterizing the component counter registration list from the EEPROM 111 in the RAM 109. In step S904, the CPU 107 checks the state of the initial value setting of the relevant component counter based on the initial counter value setting instruction in step S902. If the initial value setting is "done" (NO in step S904), since it is not necessary to set the initial counter value, the processing proceeds to step S907, and the processing ends.

If the initial value setting is "not done" (YES in step S904), the processing proceeds to step S905. In step S905, the CPU 107 sets the value specified by the setting instruction for the initial counter value in step S902 as an initial counter value for the relevant component counter. In step S906, since the initial counter value was set in step S905, which means that the relevant component counter is now in a usable state, the CPU 107 sets the initial value setting in the registration list to "done", and stores the updated registration list from the RAM 109 in the EEPROM 111.

The information about the component counter described up to this point is not only displayed on the display unit 103, but is also transmitted from the network I/F 115 to the management server 117.

Processing for transmitting the counter information to the management server will be described using FIG. 10.

The CPU 107 receives various processing requests from the network I/F 115. If one of those processing requests is a request to acquire a component counter, the CPU 107 executes the transmission processing.

Figure 10:
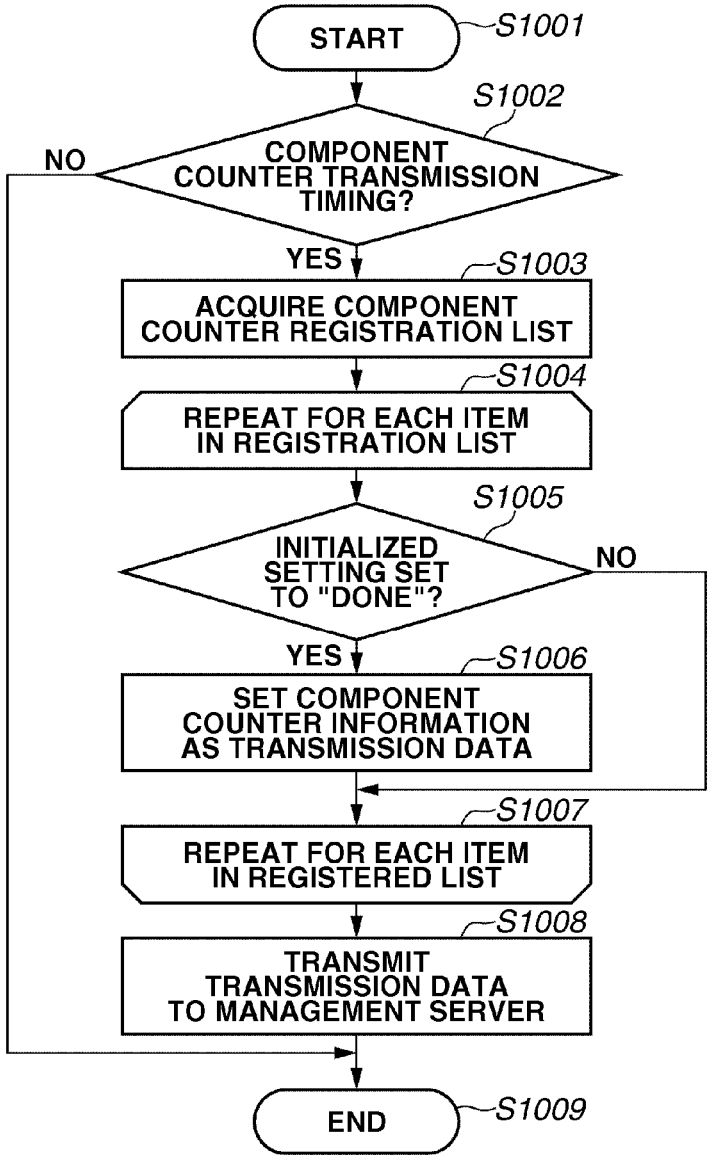
FIG. 10 is a flowchart illustrating transmission processing of counter information to a management server in an image forming apparatus according to an exemplary embodiment of the present invention.

FIG. 10 is a flowchart illustrating the transmission processing of counter information to the management server in the image forming apparatus.

In step S1001, the CPU 107 starts this processing. Then, in step S1002, the CPU 107 checks whether it is time to transmit the component counter from the management server. This check determines whether there has been an acquisition request from the management server, or whether it is now the date in the transmission schedule pre-set for the image forming apparatus.

If it is determined that it is not the transmission timing (NO in step S1002), since it is not necessary to transmit a component counter, the processing proceeds to step S1009, and the processing ends. If it is determined that it is the transmission timing (YES in step S1002), the processing proceeds to step S1003.

In step S1003, the CPU 107 gets ready for the transmission processing to the management server by rasterizing the component counter master list from the EEPROM 111 in the RAM 109.

In steps S1004 to S1008, transmission data generation is repeated for each component counter registered in the registration list. In step S1005, the CPU 107 checks whether the initialized setting of the component counter registered in the list is set to "done". If it is determined that the initialized setting is set to "not done" (NO in step S1005), since that component counter is not in a usable state, this setting is not included in the transmission data. If it is determined that the initialized setting is set to "done" (YES in step S1005), the processing proceeds to step S1006.

In step S1006, the CPU 107 converts the information about the ID, the component name, the counter value, the upper limit, the replacement date, and the number of replacements of the component counter into transmission data, and stores that data in the RAM 109. In step S1007, the transmission data generation processing is repeated on all of the component counters in the registration list, and then the processing proceeds to step S1008. In step S1008, the transmission data that has been generated up to this point is read from the RAM 109, and transmitted to the management server 117 via the network I/F 115.

Based on the above processing, only reliable component counters are transmitted to the management server 117, so that unnecessary information can be prevented from being transmitted over the network.

Aspects of the present invention can also be realized by performing following processing. Specifically, a computer of a system or apparatus (or devices such as a CPU or MPU) reads out and executes software (a program) recorded on a memory device (computer-readable medium) to perform the functions of the above-described embodiments. Examples of storage media that can be used include an optical disk, a magneto-optical disk, a CD-ROM, a magnetic tape, a non-volatile memory card.

Although in the exemplary embodiment the components of the printer unit 105 were described, the present exemplary embodiment can obviously also be applied to other components in the apparatus or the scanner unit, for example. Further, the present invention also includes a system configured from an appropriate combination of the above-described exemplary embodiment, and the functions of such a system.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-189023 filed Aug. 31, 2011, which is hereby incorporated by reference herein in its entirety.

What is claimed is:

1. An image forming apparatus capable of counting use of components in the apparatus and managing the counted number of uses as counter information, the image forming apparatus comprising:

a storage unit configured to store in a storage device counter information, identification information about a related different component in the apparatus, a count-up condition, and setting information indicating whether the counter information may be provided external to the image forming apparatus, in association with identification information about each of a plurality of components whose counter information is to be managed;

an input unit configured to receive an input for newly adding a component whose counter information is to be managed;

a registration unit configured to register in the storage device identification information about a new component to be included in the input, the identification information about the related different component in the apparatus, and the count-up condition based on the input; and a provision unit configured to provide, external to the image forming apparatus, counter information whose setting information stored in the storage device indicates that the counter information may be provided externally, wherein the registration unit is configured to, based on the input, register the counter information about the different component and the setting information indicating that the counter information may be provided externally, in association with identification information about a new component, when the identification information about the related different component in the apparatus included in the input is stored in the storage device and the count-up condition for the stored different component matches a count-up condition included in the input.

2. The image forming apparatus according to claim 1, wherein the registration unit is configured to, based on the input, register the setting information indicating that the counter information may not be provided externally, in association with the identification information about the new component, when the identification information about the related different component in the apparatus included in the input is not stored in the storage device, or the count-up condition corresponding to the identification information about the related different component in the apparatus included in the input that is stored in the storage device does not match the count-up condition included in the input.

3. The image forming apparatus according to claim 1, further comprising:

a display unit configured to display in a list identification information about a component and counter information thereof that are stored in the storage device;

an operation unit configured to receive an input operation of counter information corresponding to the new component via the list; and a first setting unit configured to, based on the input operation, set in the storage device the input counter information and the setting information indicating that the counter information may be provided externally, in association with the identification information about the new component.

4. The image forming apparatus according to claim 1, further comprising a second setting unit configured to, when a component has been replaced in the apparatus, set the counter information stored in the storage device in association with identification information about the component to zero.

5. The image forming apparatus according to claim 4, wherein the second setting unit is configured to, when a component has been replaced in the apparatus, update a setting in which the setting information indicates that the counter information may be provided externally if the setting information stored in the storage device in association with the identification information about that component indicates that the counter information may not be provided externally.

6. The image forming apparatus according to claim 1, wherein the provision unit is configured to transmit and provide counter information to a management server for remotely managing a plurality of image forming apparatuses.

7. An image forming apparatus capable of counting use of components in the apparatus and managing the counted number of uses as counter information, the image forming apparatus comprising:

a storage unit configured to store in a storage device counter information, identification information about a related different component in the apparatus, a count-up condition, and setting information indicating whether the counter information may be provided external to the image forming apparatus, in association with identification information about each of a plurality of components whose counter information is to be managed;

an input unit configured to receive an input for newly adding a component whose counter information is to be managed;

a registration unit configured to register in the storage device identification information about a new component to be included in the input, the identification information about a related different component in the apparatus, and the count-up condition based on the input; and a provision unit configured to provide, external to the image forming apparatus, counter information whose setting information stored in the storage device indicates that the counter information may be provided outside, wherein the registration unit is configured to, based on the input, register the setting information indicating that the counter information may not be provided externally, in association with identification information about a new component, when the identification information about the related different component in the apparatus included in the input is not stored in the storage device or the count-up condition corresponding to the identification information about the related different component in the apparatus included in the input that is stored in the storage device does not match a count-up condition included in the input.

8. A method for an image forming apparatus capable of counting use of components in the apparatus and managing the counted number of uses as counter information, the method comprising:

storing in a storage device counter information, identification information about a related different component in the apparatus, a count-up condition, and setting information indicating whether the counter information may be provided external to the image forming apparatus, in association with identification information about each of a plurality of components whose counter information is to be managed;

receiving an input for newly adding a component whose counter information is to be managed;

registering in the storage device identification information about a new component to be included in the input, the identification information about the related different component in the apparatus, and the count-up condition based on the input; and providing, external to the image forming apparatus, counter information whose setting information stored in the storage device indicates that the counter information may be provided externally, wherein the registering is configured to, based on the input, register the counter information about the different component and the setting information indicating that the counter information may be provided externally, in association with identification information about a new component, when the identification information about the related different component in the apparatus included in the input is stored in the storage device and the count-up condition for the stored different component matches a count-up condition included in the input.

9. A method for an image forming apparatus capable of counting use of components in the apparatus and managing the counted number of uses as counter information, the method comprising:

storing in a storage device counter information, identification information about a related different component in the apparatus, a count-up condition, and setting information indicating whether the counter information may be provided external to the image forming apparatus, in association with identification information about each of a plurality of components whose counter information is to be managed;

receiving an input for newly adding a component whose counter information is to be managed;

registering in the storage device identification information about a new component to be included in the input, the identification information about a related different component in the apparatus, and the count-up condition based on the input; and providing, outside the image forming apparatus, counter information whose setting information stored in the storage device indicates that the counter information may be provided externally, wherein the registering is configured to, based on the input, register the setting information indicating that the counter information may not be provided externally, in association with identification information about a new component, when the identification information about the related different component in the apparatus included in the input is not stored in the storage device or the count-up condition corresponding to the identification information about the related different component in the apparatus included in the input that is stored in the storage device does not match a count-up condition included in the input.

10. A computer readable storage medium on which is stored a computer program for causing a computer to execute a method for an image forming apparatus capable of counting use of components in the apparatus and managing the counted number of uses as counter information, the method comprising:

storing in a storage device counter information, identification information about a related different component in the apparatus, a count-up condition, and setting information indicating whether the counter information may be provided external to the image forming apparatus, in association with identification information about each of a plurality of components whose counter information is to be managed;

receiving an input for newly adding a component whose counter information is to be managed;

registering in the storage device identification information about a new component to be included in the input, the identification information about the related different component in the apparatus, and the count-up condition based on the input; and providing, external to the image forming apparatus, counter information whose setting information stored in the storage device indicates that the counter information may be provided externally, wherein the registering is configured to, based on the input, register the counter information about the different component and the setting information indicating that the counter information may be provided externally, in association with identification information about a new component, when the identification information about the related different component in the apparatus included in the input is stored in the storage device and the count-up condition for the stored different component matches a count-up condition included in the input.

11. A computer readable storage medium on which is stored a computer program for causing a computer to execute a method for an image forming apparatus capable of counting use of components in the apparatus and managing the counted number of uses as counter information, the method comprising:

storing in a storage device counter information, identification information about a related different component in the apparatus, a count-up condition, and setting information indicating whether the counter information may be provided external to the image forming apparatus, in association with identification information about each of a plurality of components whose counter information is to be managed;

receiving an input for newly adding a component whose counter information is to be managed;

registering in the storage device identification information about a new component to be included in the input, the identification information about a related different component in the apparatus, and the count-up condition based on the input; and providing, external to the image forming apparatus, counter information whose setting information stored in the storage device indicates that the counter information may be provided externally, wherein the registering is configured to, based on the input, register the setting information indicating that the counter information may not be provided externally, in association with identification information about a new component, when the identification information about the related different component in the apparatus included in the input is not stored in the storage device or the count-up condition corresponding to the identification information about the related different component in the apparatus included in the input that is stored in the storage device does not match a count-up condition included in the input.

* * * * *